US006499943B1

(12) United States Patent
Beeck et al.

(10) Patent No.: US 6,499,943 B1
(45) **Date of Patent: *Dec. 31, 2002**

(54) FRICTION-SUSCEPTIBLE COMPONENT OF A THERMAL TURBO MACHINE

(75) Inventors: Alexander Beeck, Kussaberg (DE); Mohamed Nazmy, Fislisbach (CH); Markus Oehl, Waldshut-Tiengen (DE); Christoph Tonnes, Brug (CH)

(73) Assignee: Alstom (Switzerland Ltd, Baden (CH)

( * ) Notice: Subject to any disclaimer, the term of this patent is extended or adjusted under 35 U.S.C. 154(b) by 2 days.

This patent is subject to a terminal disclaimer.

(21) Appl. No.: 09/635,529

(22) Filed: Aug. 9, 2000

(30) Foreign Application Priority Data

Aug. 9, 1999 (DE) ..... 199 37 577

(51) Int. Cl.[7] ..... F01D 11/00
(52) U.S. Cl. ..... 415/115; 415/200
(58) Field of Search ..... 415/115, 173.1, 415/173.4, 173.6, 174.4, 196, 197, 200

(56) References Cited

U.S. PATENT DOCUMENTS 3,964,877 A * 6/1976 Bessen et al. ..... 29/182
5,320,909 A * 6/1994 Scharman et al. ..... 428/472
6,235,370 B1 * 5/2001 Merrill et al. ..... 428/116
6,241,469 B1 * 6/2001 Beeck et al. ..... 415/115
6,312,218 B1 * 11/2001 Beeck et al. ..... 415/173.7

FOREIGN PATENT DOCUMENTS

| | | | |
|---|---|---|---|
| DE | 2945531 | B1 | 5/1981 |
| DE | 3203869 | C2 | 8/1983 |
| DE | 3235230 | C2 | 10/1997 |
| DE | 19615549 | A1 | 10/1997 |
| EP | 0132667 | | 2/1985 |

* cited by examiner

*Primary Examiner*—Edward K. Look
*Assistant Examiner*—Richard A. Edgar
(74) *Attorney, Agent, or Firm*—Burns, Doane, Swecker & Mathis, L.L.P.

(57) ABSTRACT

A component such as a turbine blade (1) of a gas turbine is provided with an intermetallic felt (2). By providing the tip (11) of the turbine blade (1) with the intermetallic felt (2) and optionally a coating of a ceramic material (3), improved protection against thermal and mechanical effects and improved oxidation resistance can be achieved. Also conceivable would be an arrangement of the intermetallic felt (2) at the rotor (4, 4*a*) or stator (4, 4*b*) opposite from the turbine blade (1) or on the platform (12) of the turbine blade (1).

20 Claims, 3 Drawing Sheets

FRICTION-SUSCEPTIBLE COMPONENT OF A THERMAL TURBO MACHINE

FIELD OF THE INVENTION

The invention relates to a friction-susceptible component, for instance, a component of a thermal turbo machine.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

The guide and rotor blades of gas turbines are subject to large loads. To minimize leakage losses of the gas turbine, the rotor blade of the gas turbine is fitted with a very small clearance to the stator, resulting in a brushing contact. The stator of the gas turbine is provided with a honeycomb structure. The honeycomb structure consists of a thermally resistant metal alloy. In another variation, smooth, coated, or uncoated heat-accumulating segments (WSS) are provided radially opposite the rotating blade on the outer radius. The blade tip then brushes against these heat-accumulating segments. To prevent the blade tip itself from being abraded, it can be coated so that the heat-accumulating segments are abraded to a greater degree. But the disadvantage of this embodiment is that the coating has only limited adhesion to the turbine blade. It is also a disadvantage that the drilled cooling air openings that may be provided on the heat-accumulating segment and/or on the blade are obstructed during the rubbing.

Documents DE-C2 32 35 230, EP-132 667 or DE-C2-32 03 869 disclose the insertion of metal felts at various locations of gas turbine components, for example at the tip of a turbine blade (DE-C2-32 03 869), between a metal core or a ceramic outer skin (DE-C2 32 35 230) or as a jacket of the turbine blade (EP-B1-132 667). But these designs have the disadvantage that the inserted metal felt does not have a sufficient oxidation resistance. Increases in hot gas temperatures, as in modern gas turbines, require that the materials used must fulfill ever-increasing requirements. The metal felts in the cited documents do not fulfill the requirement for current specifications, in particular, in relation to a necessary mass of oxidation resistance.

SUMMARY OF THE INVENTION

It is the objective of the invention to overcome these and other disadvantages. The invention realizes this objective by creating a component of a thermal turbo machine with a sufficient mechanical strength and constant cooling action at friction-susceptible locations.

According to one aspect of the invention, there is provided a friction-susceptible component of a thermal turbo machine arranged on a rotor or a stator of the thermal turbo machine, the component comprising an intermetallic felt at the friction-susceptible locations.

By selecting the composition of the intermetallic felt properly, the material has sufficient strength, oxidation resistance and plasticity. Another advantage is created when the intermetallic felt is coated with a ceramic material, since a very good adhesion of the ceramic material is achieved on the rough surface of the intermetallic felt. This provides, for example, the tip of the guide or rotor blade with good protection against thermal and friction-initiated effects. Another advantage is created in that drilled cooling air openings are not obstructed by abrasion during the operation since the material is porous.

BRIEF DESCRIPTION OF THE DRAWINGS

Preferred embodiments of the invention are illustrated in the accompanying drawings, in which.

Only those elements essential to the invention are shown. Identical elements in different drawings are provided with the same reference symbols.

DETAILED DESCRIPTION OF THE INVENTION

Figure 1:
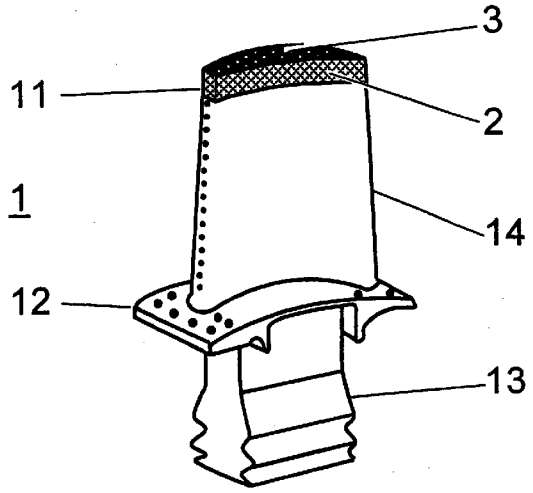
FIG. 1 is a perspective view of an embodiment of a turbine blade according to the invention with an intermetallic felt at the tip thereof.

FIG. 1 shows a turbine blade 1 with a tip 11, a blade body 14, a platform 12, and a blade base 13. This may be, for example, a guide or rotor blade of a gas turbine or compressor. According to the invention, an intermetallic felt 2 is provided at the tip 11 of this turbine blade 1. The intermetallic felt 2 can be manufactured based on a Fe aluminide, Ni aluminide or Co aluminide. The elements Ta, Cr, Y, B, and Zr are added to obtain sufficient strength, oxidation resistance, and plasticity. Table 1 shows a possible composition, for example, for a Fe aluminide and a Ni aluminide. But materials with equal properties can be used as well.

TABLE 1

| Composition of intermetallic felts (given for Fe aluminides or Ni aluminides) | | | | | | | | |
|---|---|---|---|---|---|---|---|---|
| Iron aluminides (in % by weight) | | | | | | | | |
| Fe | Al | Cr | Ta or W or Mo | Hf | Y | B | C | Zr |
| add to get 100% | 5–20% | 15–25% | 0–7% | 0–0.5% | 0–0.5% | 0–0.2% | 0–0.1% | 0–0.2% |
| Nickel aluminides (in % by weight) | | | | | | | | |
| Ni | Al | Cr | Ta | Y | Hf | Zr | B | Fe |
| add to get 100% | 20–30% | 0–15% | 0–10% | 0–0.6% | 0–1% | 0–0.2% | 0–0.2% | 0–4% |

Metallic high temperature fibers are also described in the *VDI-Bericht* 1151, 1995 (*Metallische Hochtemperaturfasern durch Schmelzextraktion—Herstellung, Eigenschaften, Anwendungen*).

Figure 7:
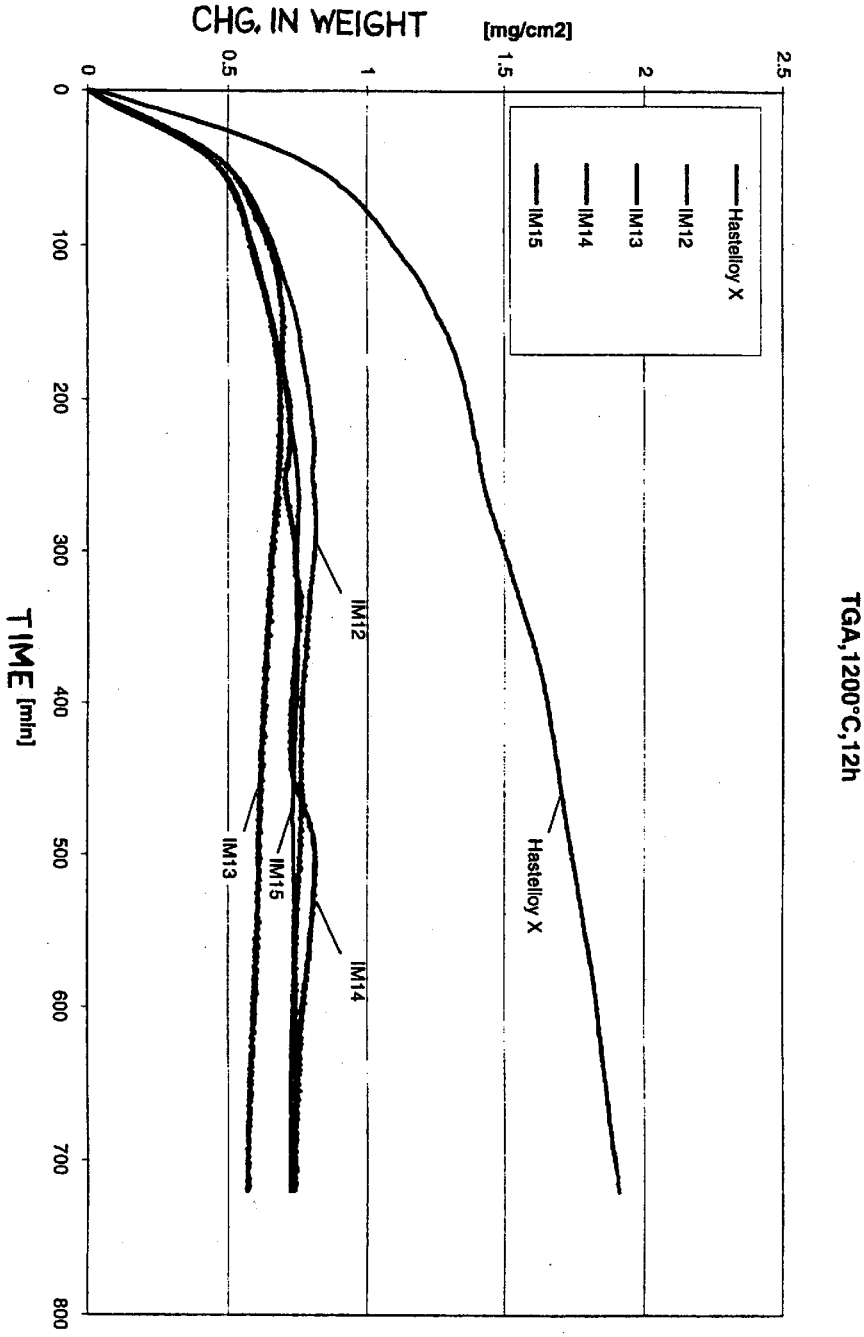
FIG. 7 is an illustration of the oxidation behavior of an intermetallic felt with a standard comparison alloy.

The advantage of the intermetallic felts 2 is their clearly improved oxidation resistance. FIG. 7 shows the oxidation of various intermetallic felts 2 in comparison with the commercial nickel base alloy Hastelloy X. Table 2 shows the composition of the test alloys.

TABLE 2

| Composition of test alloys (in % by weight) | | | | | | | | | | | | | |
|---|---|---|---|---|---|---|---|---|---|---|---|---|---|
| Name | Ni | Cr | Co | Mo | W | Al | Ta | Fe | Mn | B | Zr | Y | Hf |
| Hastelloy X | 47 | 22 | 1.5 | 9 | 0.6 | — | — | 18.5 | 0.5 | — | — | — | — |
| IM12 | 62.66 | 10 | — | — | — | 24 | — | 3 | — | 0.05 | 0.1 | 0.1 | 0.1 |
| IM13 | 44.65 | 10 | — | — | — | 15 | — | 30 | — | 0.05 | 0.1 | 0.1 | 0.1 |
| IM14 | 6.48 | 22 | — | — | — | 10 | — | 3 | — | — | — | 0.2 | — |
| IM15 | 60 | 9 | — | — | — | 27 | 2 | 1.6 | — | — | 0.2 | 0.2 | — |

FIG. 7 shows the increase in weight of the compositions shown in Table 2 in [mg/cm$^2$] over a period of 12 hours at a temperature of 1200° C. The increase in weight has been shown in place of the oxidation of the materials. FIG. 7 shows that the control alloy Hastelloy X has double the weight increase even after a brief time of about 100 to 300 minutes. With increasing time, the weight of Hastelloy X continuously increases, while the intermetallic felts IM12–15 remain at a constant value between 0.6–0.8 mg/cm$^2$. It is clear that the oxidation resistance is much better in the intermetallic felts. For the inventive incorporation of the intermetallic felt at friction-susceptible locations of a thermal turbo machine, oxidation resistance is one of the most important factors affecting the life of the entire component.

In order to increase the strength of this turbine blade 1 of FIG. 1 at tip 11 even further, the intermetallic felt 2 can be coated with a ceramic material 3, for example with a TBC (thermal barrier coating). The TBC is a Zr oxide stabilized with Y. Equivalent materials could also be used. The ceramic material 3 can be sprayed onto an intermetallic felt 2. Because of the uneven surface of the intermetallic felt 2, it has very good adhesion and good oxidation resistance. The ceramic material 3 is very good protection against thermal and mechanical, e.g. friction-based effects. As a further advantage, drilled cooling air openings that may be provided in the turbine blade 1 or on the rotor/stator 4 cannot become obstructed since the intermetallic felt 2 is a porous material.

Figure 2:
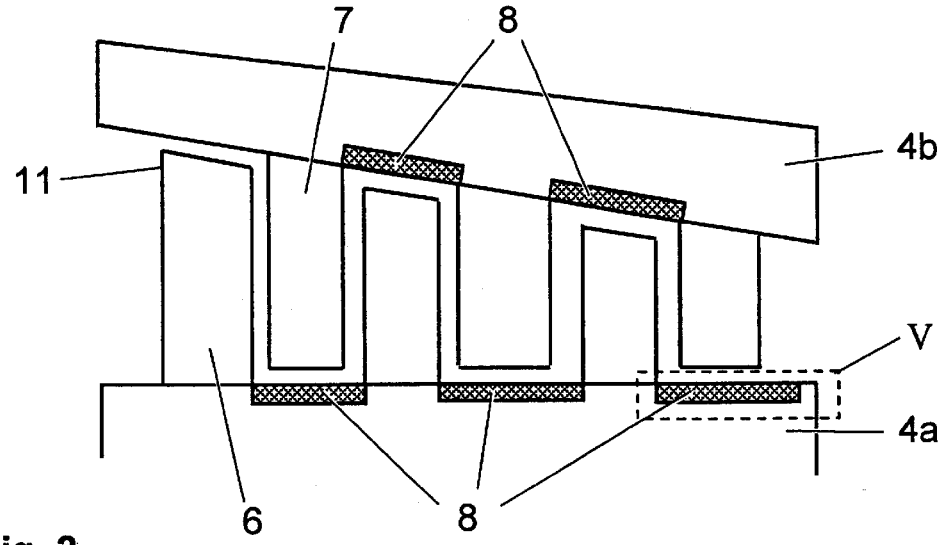
FIG. 2 is a side view of an embodiment of a gas turbine with heat-accumulating segments arranged so as to be located opposite from the guide or rotor blade and consisting of an intermetallic felt.

FIG. 2 shows another embodiment. FIG. 2 shows a schematic illustration of a gas turbine with a rotor 4*a*, a stator 4*b*. Rotor blades 6 are attached to the rotor 4*a*, guide blades 7 to the stator 4*b*. Heat exchange segments 8 that are usually opposite from the guide/rotor blades 6,7 are arranged on the rotor 4*a* or stator 4*b*. According to the invention, these heat-accumulating segments 8 also may consist either in their entirety or partly of an intermetallic felt. The porous properties of the material also permit improved cooling at this location if abrasion has occurred, since the porous structure of the intermetallic felt prevents an obstruction from forming. As already described, the abrasion can be reduced with a layer of TBC. The component also may be cooled under the TBC layer since the cooling medium is able to escape laterally through the porous felt.

Figure 5:
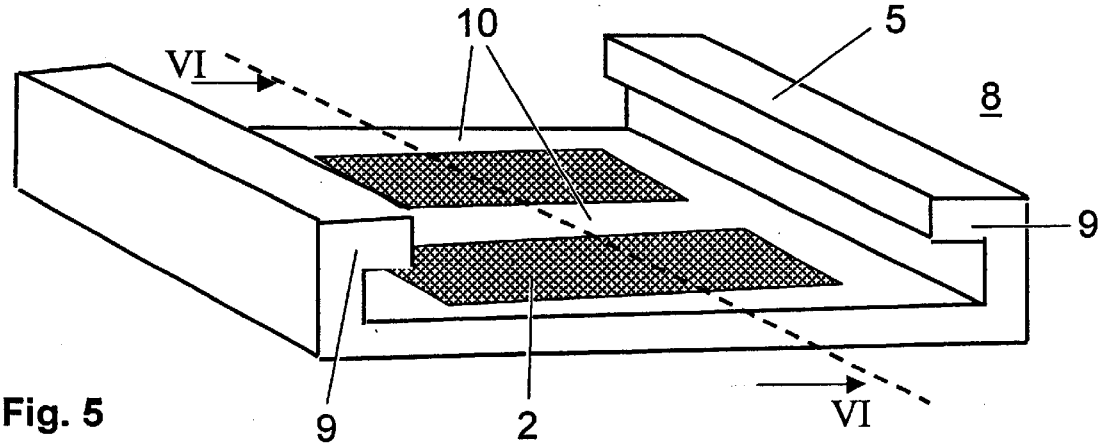
FIG. 5 shows a perspective view of a heat-accumulating segment according to the invention with a supporting base structure at area V in FIG. 2.
Figure 6:
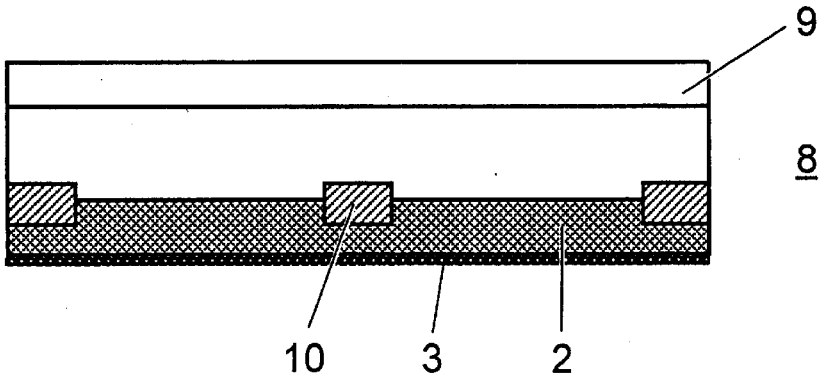
FIG. 6 shows a cross-sectional view of the heat-accumulating segment along line VI—VI in FIG. 5.

FIG. 5 shows a heat-accumulating segment 8 according to the invention shown as an enlargement of area V in FIG. 2. The intermetallic felt 2 was attached to a supporting base structure 5. The supporting base structure 5 has attachment means 9 that are used to attach the rotor 4*a* or stator 4*b* (not shown in FIG. 5). The lateral attachment means 9 are interconnected with bars 10 (FIG. 6). Between the bars 10, on the side facing the turbine blades, the intermetallic felt 2 is inserted and mechanically connected. This may be achieved, for example, by soldering, welding, or casting.

FIG. 6 shows the section VI–VI of FIG. 5. It shows that the bars 10 connecting the two attachment means 9 do not penetrate through the intermetallic felt 2, but the intermetallic felt 2 is only attached to them. As can be seen from FIG. 6, the intermetallic felt 2 can again be coated with a ceramic material 3, for example a TBC (thermal barrier coating), in order to increase the temperature resistance of the heat-accumulating segment 8 even more. Equivalent materials could be used also. As was the case for the turbine blade in FIG. 1, a cooling effect is maintained even if there is abrasion since the intermetallic felt 2 cannot be obstructed.

Figure 3:
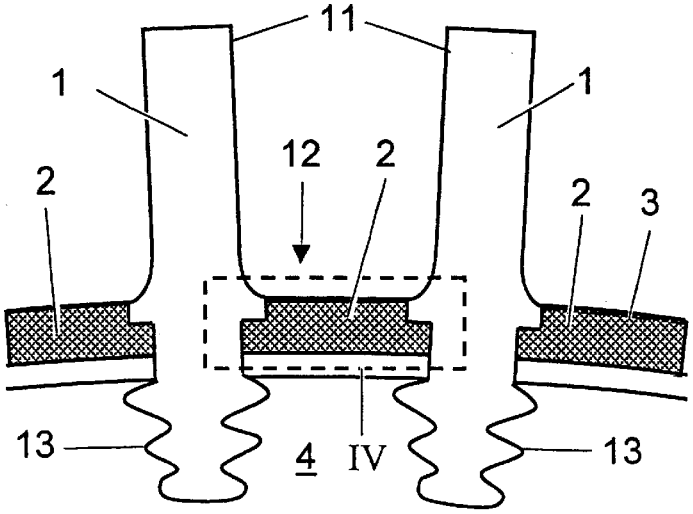
FIG. 3 shows a partial view of a second embodiment of a turbine blade according to the invention, whereby the intermetallic felt is arranged on the platform of the turbine blades.

To achieve better cooling, the intermetallic felt in the exemplary embodiment of FIG. 3 is attached to the platform 12 of the turbine blade 1 of the thermal turbo machine. As has already been described in FIGS. 1, 2, 5, and 6, it is also useful here to coat the felt 2 with a ceramic material 3. This has the advantage that the TBC adheres especially well to the intermetallic felt and the felt is oxidation- resistant. No additional binding layer (for example MCrAlY) is needed. In FIG. 3, this TBC layer 3 is shown next to the right turbine blade 1. The TBC also protects against wear.

Figure 4:
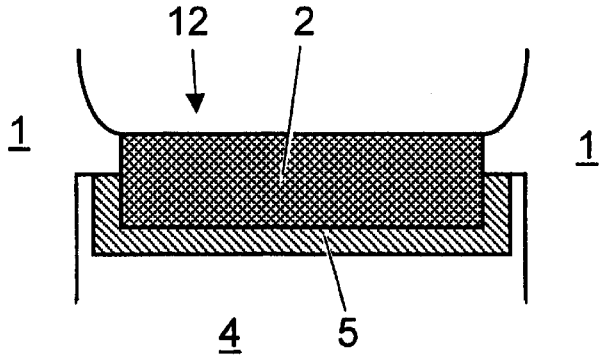
FIG. 4 shows an enlarged view along area IV of FIG. 3 of a variation of the second embodiment, whereby the intermetallic felt is located between the turbine blades on the platforms of the turbine blades on a supporting base structure.

FIG. 4 shows a second variation of the exemplary embodiment as an enlargement of area of detail IV from FIG. 3. Between consecutive turbine blades 1, on platform 12 of the turbine blades 1, the intermetallic felt 2 is attached to a supporting base structure 5 a cast part or other metal. The supporting base structure 5 also may include several chambers in order to ensure an optimum air supply to the intermetallic felt 2.

While the present invention has been described by reference to the above-described embodiments, certain modifications and variations will be evident to those of ordinary skill in the art. Therefore the present invention is to limited only by the scope and spirit of the appended claims.

We claim:

1. A friction-susceptible component of a thermal turbo machine arranged on a rotor or a stator of the thermal turbo machine comprising an intermetallic felt at friction-susceptible locations of the component, said intermetallic felt being porous and including metallic high temperature fibers.

2. The component of claim 1, wherein cooling air flows through the intermetallic felt.

3. The component of claim 1, wherein the component is a heat-accumulating segment, and the heat-accumulating segment is provided at least partially with the intermetallic felt.

4. The component of claim 1, wherein the intermetallic felt is coated with a ceramic material.

5. The component of claim 1, wherein the intermetallic felt comprises a Fe aluminide with the following composition in % by weight: 5–20% Al, 15–25% Cr, 0–7% of at least one of Ta or W or Mo, 0–0.5% Hf, 0–0.5% Y, 0–0.2% B, 0–0.1% C, 0–0.2% Zr, and Fe, the balance to make 100%, and inevitable contaminants.

6. The component of claim 1, wherein the intermetallic felt comprises a Ni aluminide with the following composition in % by weight: 20–30% Al, 0–15% Cr, 0–10% Ta, 0–0.5% Y, 0–1% Hf, 0–0.2% Zr, 0–0.2% B, 0–4% Fe, Ni, the balance to make 100%, and inevitable contaminants.

7. The component of claim 1, wherein the component is a turbine blade comprising a platform and the platform is provided with the intermetallic felt.

8. The component of claim 7, wherein the intermetallic felt is attached to a supporting base structure.

9. The component of claim 8, wherein the intermetallic felt is attached mechanically to the supporting base structure, by soldering, welding, or casting.

10. The component of claim 9, wherein the intermetallic felt is coated with a ceramic material.

11. The component of claim 9, wherein the intermetallic felt comprises a Fe aluminide with the following composition in % by weight: 5–20% Al, 15–25% Cr, 0–7% of at least one of Ta or W or Mo, 0–0.5% Hf, 0–0.5% Y, 0–0.2% B, 0–0.1% C, 0–0.2% Zr, and Fe, the balance to make 100%, and inevitable contaminants.

12. The component of claim 9, wherein the intermetallic felt comprises a Ni aluminide with the following composition in % by weight: 20–30% Al, 0–15% Cr, 0–10% Ta, 0–0.5% Y, 0–1% Hf, 0–0.2% Zr, 0–0.2% B, 0–4% Fe, Ni, the balance to make 100%, and inevitable contaminants.

13. The component of claim 1, wherein the component is a turbine blade comprising a tip provided with the intermetallic felt.

14. The component of claim 13, wherein the intermetallic felt is coated with a ceramic material.

15. The component of claim 13, wherein the intermetallic felt comprises a Fe aluminide with the following composition in % by weight: 5–20% Al, 15–25% Cr, 0–7% of at least one of Ta or W or Mo, 0–0.5% Hf, 0–0.5% Y, 0–0.2% B, 0–0.1% C, 0–0.2% Zr, and Fe, the balance to make 100%, and inevitable contaminants.

16. The component of claim 13, wherein the intermetallic felt comprises a Ni aluminide with the following composition in % by weight: 20–30% Al, 0–15% Cr, 0–10% Ta, 0–0.5% Y, 0–1% Hf, 0–0.2% Zr, 0–0.2% B, 0–4% Fe, Ni, the balance to make 100%, and inevitable contaminants.

17. The component of claim 1, further comprising a supporting base structure comprising attachments for attachment on the rotor or stator, and bars located between the attachments, the intermetallic felt is attached mechanically between the attachments on the bars.

18. The component of claim 17, wherein the intermetallic felt is coated with a ceramic material.

19. The component of claim 17, wherein the intermetallic felt comprises a Fe aluminide with the following composition in % by weight: 5–20% Al, 15–25% Cr, 0–7% of at least one of Ta or W or Mo, 0–0.5% Hf, 0–0.5% Y, 0–0.2% B, 0–0.1% C, 0–0.2% Zr, and Fe, the balance to make 100%, and inevitable contaminants.

20. The component of claim 17, wherein the intermetallic felt comprises a Ni aluminide with the following composition in % by weight: 20–30% Al, 0–15% Cr, 0–10% Ta, 0–0.5% Y, 0–1% Hf, 0–0.2% Zr, 0–0.2% B, 0–4% Fe, Ni, the balance to make 100%, and inevitable contaminants.

* * * * *